US011326409B2

(12) United States Patent
Eis et al.

(10) Patent No.: US 11,326,409 B2
(45) Date of Patent: May 10, 2022

(54) FRAC PLUG SETTING TOOL WITH TRIGGERED BALL RELEASE CAPABILITY

(71) Applicant: HALLIBURTON ENERGY SERVICES, INC., Houston, TX (US)

(72) Inventors: Andrew John Eis, Williston, ND (US); Tyler Norman, Carrollton, TX (US); Jesse Cale Porter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/636,224

(22) PCT Filed: Sep. 6, 2017

(86) PCT No.: PCT/US2017/050258

§ 371 (c)(1),
(2) Date: Feb. 3, 2020

(87) PCT Pub. No.: WO2019/050512

PCT Pub. Date: Mar. 14, 2019

(65) Prior Publication Data

US 2021/0164306 A1 Jun. 3, 2021

(51) Int. Cl.
*E21B 23/00* (2006.01)
*E21B 33/12* (2006.01)

(52) U.S. Cl.
CPC ..... *E21B 23/00* (2013.01); *E21B 33/12* (2013.01); *E21B 2200/05* (2020.05)

(58) Field of Classification Search
CPC ..... E21B 23/00; E21B 33/12; E21B 2200/05; E21B 2200/06; E21B 33/14; E21B 23/06; E21B 34/14
See application file for complete search history.

(56) References Cited

U.S. PATENT DOCUMENTS 2,735,498 A * 2/1956 Muse ..... E21B 21/10 166/317
3,376,935 A * 4/1968 Baker ..... E21B 21/10 166/317
4,406,335 A * 9/1983 Koot ..... E21B 34/14 166/318
4,577,614 A * 3/1986 Schoeffler ..... E21B 21/106 175/218

(Continued)

FOREIGN PATENT DOCUMENTS

WO 2016171915 10/2016

OTHER PUBLICATIONS

International Search Report and Written Opinion dated May 30, 2018, issued in corresponding PCT Application No. PCT/US2017/050258.

*Primary Examiner* — Steven A MacDonald
(74) *Attorney, Agent, or Firm* — McAfee & Taft

(57) ABSTRACT

A downhole tool and process for introducing the downhole tool into a wellbore are provided wherein the downhole tool includes an occlusion-releasing tool. The occlusion-releasing tool contains an occlusion until such time as it is needed in a frac plug to prevent flow in one direction in the wellbore. The occlusion is released from the occlusion-releasing tool by fluid flow through the occlusion-releasing tool. The fluid flow acts directly on the occlusion to provide sufficient pressure to release the occlusion from a mechanical retainer.

19 Claims, 5 Drawing Sheets

(56) References Cited

U.S. PATENT DOCUMENTS 5,435,390 A * 7/1995 Baugh ..... E21B 33/05 166/285
6,220,360 B1 * 4/2001 Connell ..... E21B 23/00 166/373
6,672,384 B2 * 1/2004 Pedersen ..... E21B 33/05 166/177.4
8,042,615 B1 * 10/2011 Wattenburg ..... E21B 33/06 166/373
8,267,177 B1 * 9/2012 Vogel ..... E21B 33/134 166/317
8,403,068 B2 * 3/2013 Robison ..... E21B 43/26 166/386
8,479,808 B2 * 7/2013 Gouthaman ..... E21B 34/105 166/156
9,664,015 B2 * 5/2017 Hofman ..... E21B 43/14
9,719,321 B2 * 8/2017 Hern ..... E21B 34/14
9,810,036 B2 * 11/2017 Mailand ..... E21B 43/119
10,428,623 B2 * 10/2019 Silva ..... E21B 23/04
10,443,338 B2 * 10/2019 Mailand ..... E21B 23/06
2002/0033262 A1 * 3/2002 Musselwhite ..... E21B 34/14 166/285
2009/0159297 A1 * 6/2009 Fould ..... E21B 23/04 166/385
2010/0132954 A1 * 6/2010 Telfer ..... E21B 23/006 166/373
2012/0227973 A1 * 9/2012 Hart ..... E21B 23/006 166/329
2013/0075087 A1 * 3/2013 Algeroy ..... E21B 41/00 166/250.01
2014/0246207 A1 * 9/2014 Hofman ..... E21B 43/26 166/373
2014/0360720 A1 * 12/2014 Corbeil ..... E21B 33/068 166/284
2015/0068727 A1 * 3/2015 Hern ..... E21B 33/16 166/114
2015/0247375 A1 * 9/2015 Stout ..... E21B 33/1265 166/308.1
2016/0061018 A1 * 3/2016 Ditzler ..... E21B 23/00 166/250.04
2016/0257786 A1 * 9/2016 Fripp ..... E21B 43/26

* cited by examiner

FRAC PLUG SETTING TOOL WITH TRIGGERED BALL RELEASE CAPABILITY

FIELD

The present disclosure relates generally to equipment utilized in operations performed in conjunction with subterranean wells and, more particularly, to controlled release of an occlusion or plug.

BACKGROUND

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with cement. This serves to form a cement sheath. The combination of cement and casing strengthens the wellbore and facilitates the isolation of the formations behind the casing.

It is common to place several strings of casing having progressively smaller outer diameters into the wellbore. Thus, the process of drilling and then cementing progressively smaller strings of casing often is repeated several times until the well has reached total depth. The final string of casing, referred to as a production casing, is cemented into place. In some instances, the final string of casing is a liner, that is, a string of casing that is not tied back to the surface, but is hung from the lower end of the preceding string of casing. In some instances the production casing or liner is not cemented in place.

As part of the completion process, the production casing is perforated at a desired level. This means that lateral holes are shot through the casing and the cement sheath surrounding the casing to allow hydrocarbon fluids to flow into the wellbore. Thereafter, other well completion and production operations, such as fracturing, can be performed.

In the drilling and reworking of oil wells, a great variety of downhole tools is used. For example, but not by way of limitation, downhole tools are used to seal tubing or other pipe in the well. Downhole tools referred to as packers, frac plugs and bridge plugs are designed for these general purposes and are well known in the art of producing oil and gas.

During perforation operations, frac plugs are often used to isolate the well above the frac plug. Frac plugs allow fluid flow in one direction but prevent flow in the other. For example, frac plugs set in a well may allow fluid from below the frac plug to pass upwardly therethrough but when the slurry is pumped into the well, the frac plug will not allow fluid flow down through the frac plug so that any fluid being pumped down the well may be forced into a formation above the frac plug.

Typically, a frac plug will utilize an occlusion (sometimes referred to as a plug or ball plug; although it does not have to have a spherical shape) that sits on a seat defined in the frac plug. Flow through a central bore of the frac plug is not blocked until the occlusion is in place. Thus, in the course of treating and preparing subterranean wells for production, a frac plug is run into the well on a work string, a production tubing or wireline. The frac plug is typically provided with anchor assemblies having opposed caroming surfaces which cooperate with complementary opposed wedging surfaces; whereby the anchor slips are radially extendible into gripping engagement against the well casing bore in response to relative axial movement of the wedging surfaces. The frac plug also carries annular sealing elements, which are expandable radially into sealing engagement against the casing.

It is often desired to deliver the occlusion with the deployment of a perforation gun used for perforation operations to minimize operation time and expense. However, in the use of a frac plug for perforating operations, it can be desirable not to restrict such downward flow past the frac plug during placement of the perforation gun. Also, problems occur if a frac plug has the occlusion on the frac plug seat in the event there is a miss-run, such as the perforation guns not firing. In such an occurrence, a subsequent run of perforating guns cannot be introduced unless the occlusion first is reversed out, which isn't always possible. When reversing the occlusion out is possible, it adds to time and cost.

BRIEF DESCRIPTION OF THE DRAWINGS

For a detailed understanding of the apparatus and methods disclosed herein, reference should be made to the accompanying drawings and the detailed description thereof, wherein like elements are generally given the same numerals and wherein:

FIG. 8 illustrates an occlusion-releasing device attached to a frac plug in accordance with another embodiment.

FIG. 9 illustrates the occlusion-releasing device of FIG. 8 after separation from the frac plug.

DETAILED DESCRIPTION

In the description that follows, the drawings are not necessarily to scale and the proportions of certain parts have been exaggerated to better illustrate details and features of the invention. In the following description, the terms "upper," "upward," "lower," "below," "downhole" and the like as used herein shall mean in relation to the bottom or furthest extent of the surrounding wellbore even though the wellbore or portions of it may be deviated or horizontal. The terms "inwardly" and "outwardly" are directions toward and away from, respectively, the geometric axis of a referenced object. Where components of relatively well-known designs are employed, their structure and operation will not be described in detail.

Figure 1:
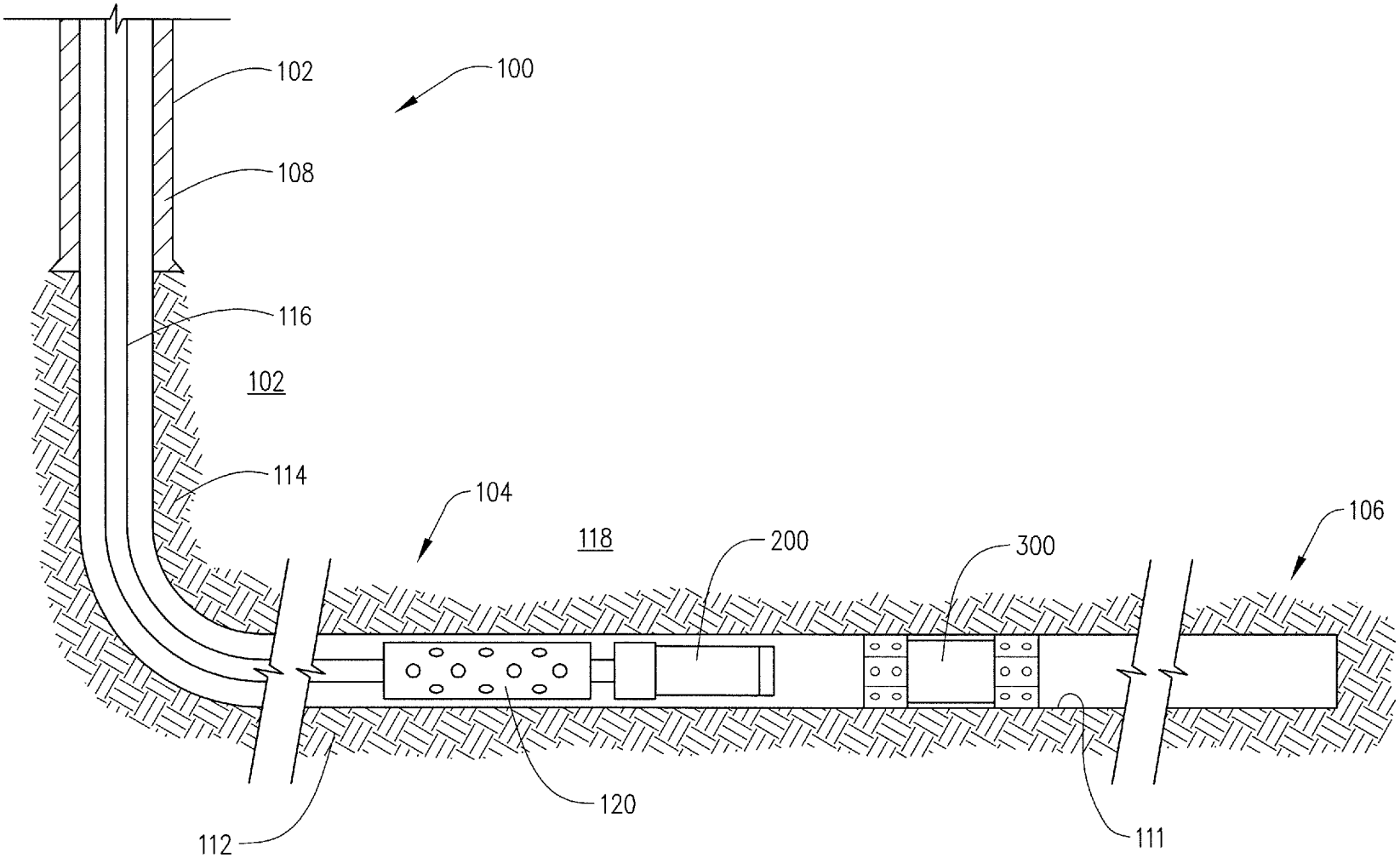
FIG. 1 illustrates an exemplary wellbore system that includes a frac plug and an occlusion-releasing device in accordance with one embodiment.

With reference to the drawings, FIG. 1 is a schematic diagram of a wellbore system 100 that may be used for completion operations in a subterranean formation 102 with one or more production zones 104, 106, etc. The system can include a casing 108 cemented in wellbore 110 formed in formation 102. The casing illustrated extends partially down wellbore 110; however, the casing can extend farther than shown and, in some cases, can extend to the downstream end of the wellbore. In certain embodiments, wellbore 110 is cemented with cement 112 in an open hole 114 without casing 108. One or more downhole tools can be lowered down on tubing or tubular 116, so that the tools are deployed within wellbore 110 to a downhole location 118. In certain embodiments, downhole location 118 and zones 104, 106, etc., are in horizontal or near horizontal orientations.

In an exemplary embodiment, during completion operations, such as "plug and perforation" operations, a perforation gun 120, occlusion-releasing tool 200 (also called occlusion-releasing device) and frac plug 300 are deployed on tubing 116 to downhole location 118. As illustrated, frac plug 300 has been set in wellbore 110 so as to engage wellbore wall 111. After frac plug 330 engages wellbore wall 111, it is released from the tubing stream. Frac plug 300 allows for a flow therethrough when unobstructed. As illustrated, perforation gun 120 is lowered down wellbore 110 with occlusion-releasing tool 200 and frac plug 300. However, in some embodiments perforation gun 120 can be lowered into wellbore 110 after frac plug 300 has been set.

The perforation gun 120 may be fired in downhole location 118 in response to wellbore events. After certain wellbore conditions are met, such as a combination of elapsed time, wellbore pressure, wellbore temperature, etc., the occlusion-releasing tool 200 releases an occlusion, such as a ball plug, into frac plug 300 to stop fluid flow beyond the plugged area to allow completion operations, such as fracking. In certain embodiments, it is desirable to deploy the occlusion into frac plug 300 after the perforation gun 120 has successfully created perforations at the downhole location 118. In an exemplary embodiment, the increased fluid pressure caused by firing perforation gun 120 causes the release of the occlusion from occlusion-releasing tool 200. Otherwise, an operator may choose to release the occlusion by increasing fluid pressure on the occlusion when certain conditions are met or for any suitable operating parameter. In order to deploy the occlusion under the desired conditions, occlusion-releasing tool 200 is utilized to selectively release the occlusion. A non-limiting embodiment of an occlusion-releasing tool 200 is described with reference to FIGS. 2 and 3.

Figure 2:
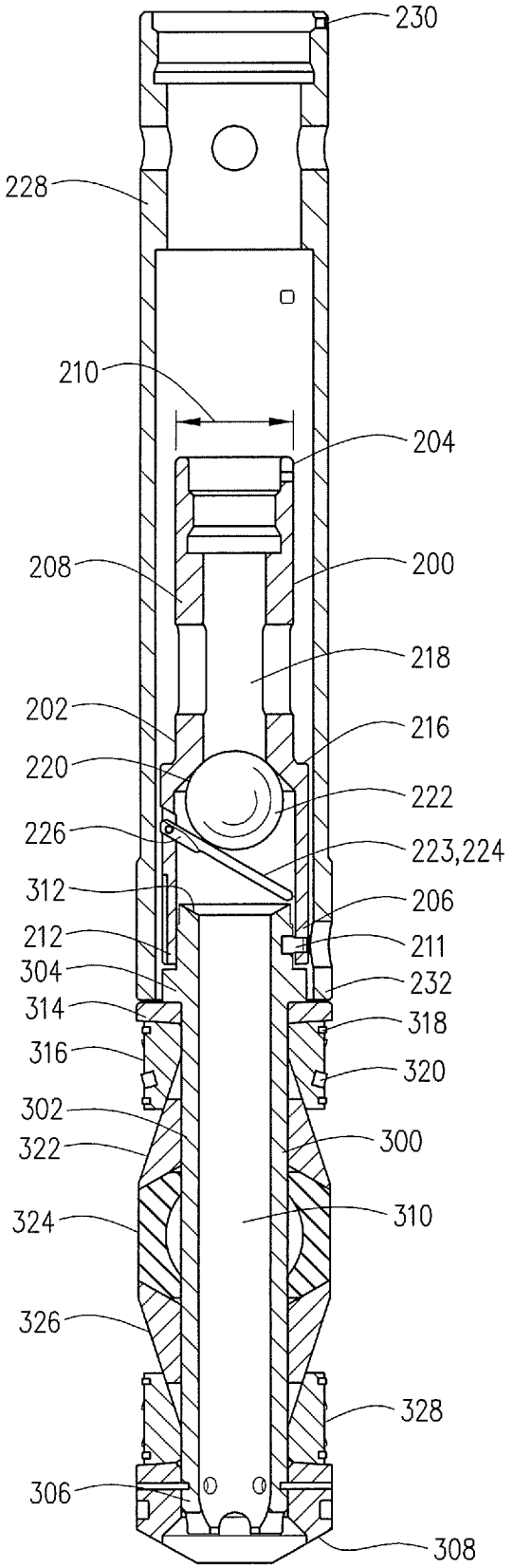
FIG. 2 illustrates an occlusion-releasing device attached to a frac plug in accordance with an embodiment.
Figure 3:
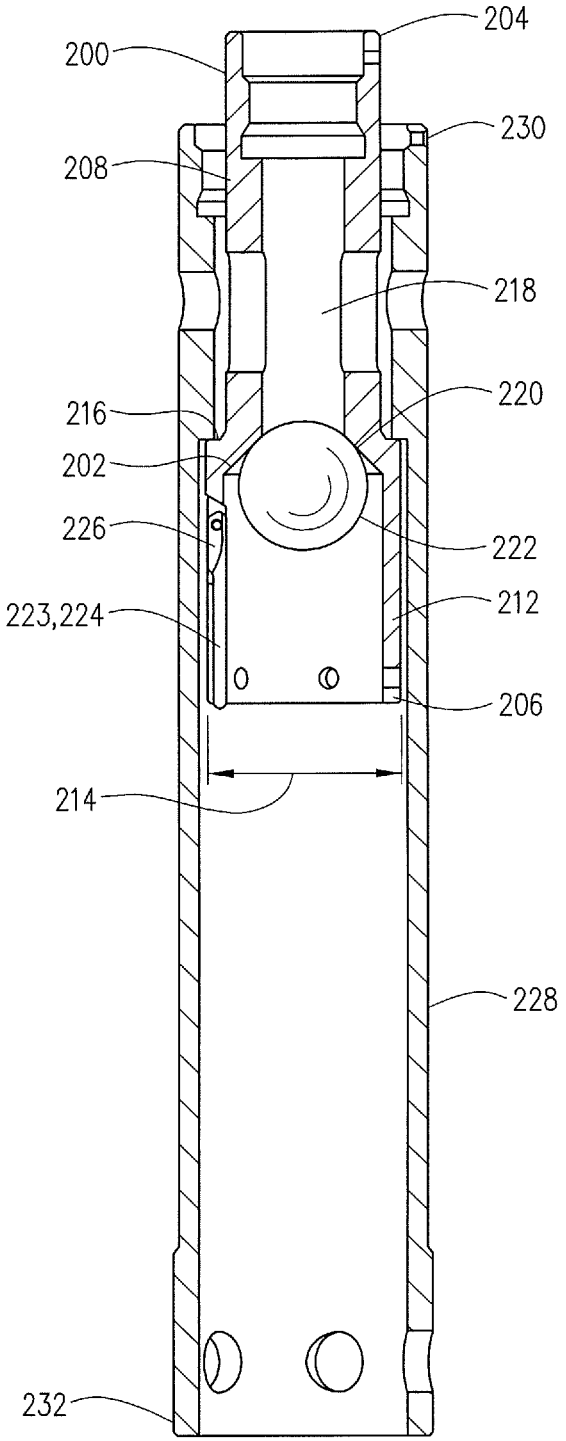
FIG. 3 illustrates the occlusion-releasing device of FIG. 2 after separation from the frac plug and with the flapper in the open position.

FIGS. 2 and 3 show a cross-sectional view of a non-limiting embodiment of occlusion-releasing tool 200 for use in a wellbore system, including the wellbore system shown in FIG. 1. FIG. 2 illustrates occlusion-releasing tool 200 connected to frac plug 300 as they would be during deployment in wellbore 110 and before frac plug 300 is set. FIG. 3 illustrates occlusion-releasing tool 200 after frac plug 300 has been set and separated from occlusion-releasing tool 200. FIG. 3 illustrates occlusion-releasing tool 200 just after a mechanical retainer 223 (in this embodiment flapper 224) has been moved to its open position and just prior to occlusion 222 being moved downhole towards frac plug 300.

Specifically looking at FIG. 2, there is illustrated occlusion-releasing tool 200 connected to frac plug 300. Occlusion-releasing tool 200 comprises a shaft 202 with a first or upper end 204 and a second or lower end 206. Shaft 202 has neck portion 208 with an outer diameter 210, a body portion 212 with an outer diameter 214, which is greater than outer diameter 210 of neck portion 208. A shoulder 216 is positioned at the intersection of neck portion 208 and body portion 212 and extends therebetween. At upper end 204, neck portion 208 is configured to attach to tubing or another tool, such as tubing 116 or perforation gun 120. At lower end 206, body portion 212 is configured to attach to frac plug 300. The attachment may be by one or more shear pins 211 or a similar means that allows the connection to break due to down pressure on frac plug 300 such as by a setting tool.

Shaft 202 defines a flow passage 218 therethrough extending from the upper end 204 to the lower end 206 thereof. As will be appreciated, flow passage 218 extends longitudinally along a central axis of shaft 202. A seat 220 is defined within body portion 212. Seat 220 is configured to receive an occlusion 222, such that upward fluid flow pushes occlusion 222 into engagement with seat 220 and downward flow pushes occlusion out of engagement with seat 220. Seat 220 and occlusion 222 can, but do not need to have, a sealing engagement. That is, in many embodiments, when there is upward fluid flow or upward fluid pressure on occlusion 222, occlusion 222 will engage seat 220 but still allow fluid to flow past the engagement of occlusion 222 with seat 220. Typically, fluid within flow passage 218 can flow against and around the occlusion when the occlusion is contained within body portion 212.

Shaft 200 further comprises a mechanical retainer 223 within body portion 212. In this embodiment, mechanical retainer 223 is flapper 224, which is a spring-loaded flapper and is resiliently biased to a closed position (as illustrated in FIG. 2) by a spring 226. In the closed position, flapper 224 holds occlusion 222 within body portion 212 and can hold occlusion 222 in engagement with seat 220. Flapper 224 holds occlusion 222 within body portion 212 until a predetermined fluid pressure is asserted on occlusion 222 from uphole within flow passage 218. Typically, the predetermined fluid pressure will be asserted by a downward flowing fluid within flow passage 218. For example, the predetermined fluid pressure can be achieved by the firing of perforating gun 120; thus, causing sufficient downward fluid flow and fluid pressure on occlusion 222 to overcome the bias of spring 226 to move flapper 224 to the open position illustrated in FIG. 3. Presently it is considered advantageous that the current embodiments of the occlusion release tool can release the occlusion by direct action of fluid flow on the occlusion to overcome the mechanical retainer thus the release is without the use of plunger or other mechanical or electrical release mechanisms.

As illustrated in FIG. 2, while frac plug 300 is connected to lower end 206 of shaft 202 (prior to setting of frac plug 300 in the wellbore), the upper end 304 of frac plug 300 is positioned so as to prevent flapper 224 from moving to the open position; thus, preventing occlusion 222 from being released from body portion 212 prior to setting of the frac plug. After frac plug 300 has been set and released from shaft 202, occlusion-releasing tool 200 is moved uphole so that upper end 304 no longer prevents flapper 224 from opening and flapper 224 can be moved to its open position by downward fluid flow in flow passage 218, as shown in FIG. 3.

Occlusion-releasing tool 200 further comprises a setting sleeve 228, which circumferentially surrounds and slidingly engages shaft 202. An upper or first end 230 of setting sleeve 228 is configured to attach to a setting tool so that the setting tool can slide setting sleeve 228 relative to shaft 202. A lower or second end 232 of setting sleeve 228 engages frac plug 300 so that when setting sleeve 228 is moved downward relative to shaft 202, frac plug 300 is moved into a set position, further described below. After frac plug 300 is set, additional downward force on setting sleeve 228 causes shear pins 211 to break thus releasing lower end 206 of shaft 202 from upper end 304 of frac plug 300.

As will be described in detail herein, frac plug 300 may be configured as a standard frac plug, which is configured so that an occlusion engages the upper end thereof. Frac plug 300 comprises a mandrel 302 with a first or upper end 304 and a second or lower end 306. Upper end 304 is configured to attach to lower end 204 of shaft 202, such as by shear pins 211 described above. Lower end 306 can terminate in a shoe or end piece 308. Mandrel 302 defines a flow passage 310 therethrough extending from the upper end 304 to the lower end 306 thereof. As will be appreciated, flow passage 310 extends longitudinally along a central axis of mandrel 302. A seat 312 is defined at upper end 304. Seat 312 is configured so that occlusion 222 can sealingly engage seat 312; that is, when occlusion 222 is brought into engagement with seat 312 fluid flow downhole through flow passage 310 of frac plug 300 is prevented. Further, frac plug 300 sealingly engages the wellbore when set; thus preventing fluid flow around the outside of frac plug 300.

Frac plug 300 may include a spacer ring 314 pinned to mandrel 302 to axially retain slip segments 316 which are circumferentially positioned about mandrel 302. Slip retaining band 318 may be utilized to radially retain slip segments 316 in the initial or unset position shown in FIG. 2. Slips 316 may include a plurality of buttons 320, which may be for example like those disclosed in U.S. Pat. No. 5,984,007 assigned to the assignee hereof Band 318 may be made of steel wire, plastic material or composite material having the requisite characteristics in sufficient strength to hold the slips in place while running frac plug 300 in the well and prior to setting.

A slip wedge 322 may be initially positioned in a slidable relationship to and partially beneath slip segments 316. Slip wedge 322 may be pinned in place with a pin. Packer-element assembly 324, which in the embodiment shown comprises a single expandable sealing or packer element, is disposed about mandrel 302. While illustrated as a single element, multiple sealing elements can be used.

Beneath packer-element assembly 324 are slip wedge 326 and slip segments 328, which are similar to slip wedge 322 and slip segments 316, respectively. Some embodiments can use only a single set of slip wedges and slip segments.

Typically, when the setting tool is actuated, it will move shaft 202 upwardly, with setting sleeve 228 remaining stationary. Mandrel 302 will be pulled upwardly since it is fixedly attached to shaft 202. Components disposed about mandrel 302 will be compressed, since spacer ring 314 is held essentially stationary by setting sleeve 228. The compression of the components about frac plug 300 results in slip segments 316 sliding over and moving radially outward upon slip wedge 322 and slip segments 328 sliding over and moving radially outward upon slip wedge 326 until slips segments 316 and 328 grippingly engage the wellbore to thus hold frac plug 300 in position. Sealing elements 324 will be expanded outwardly and moved to the set position in which they engage wellbore 110, which could be a casing lining the wellbore. When tool 300 is moved to the set position, shear pins 211 are designed to shear, so that occlusion-releasing tool 200 will be released from frac plug 300 and can be pulled upwardly. Shear pins 211 are designed to shear at the load required to move frac plug 300 to the set position, which may be, for example, 20,000 to 30,000 pounds. The loads provided herein are non-limiting and are merely exemplary.

In FIG. 2, frac plug 300 is shown in the unset or run-in position. As can best be seen in FIG. 4, frac plug 300 is run into wellbore 110 while being connected to occlusion-releasing tool 200. Occlusion-releasing tool 200 can be connected to and lowered on tubing string 116. Once frac plug 300 is at a predetermined location in wellbore 110, a setting tool 402 is used to move setting sleeve 228 downward; thus, moving frac plug 300 to its set position and releasing frac plug 300 from occlusion-releasing tool 200, as shown in FIG. 5. In its set position, packer-element assembly 324 is in sealing engagement with wellbore 110 thus preventing fluid flow in the annulus between frac plug 300 and the wellbore 110.

Figure 4:
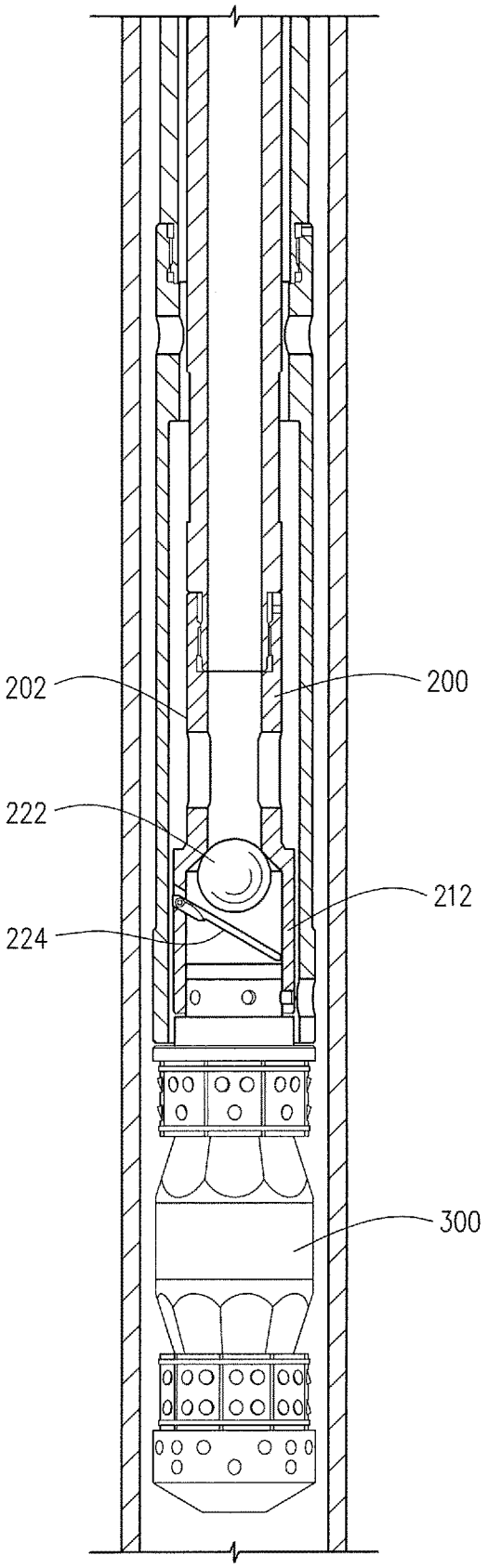
FIG. 4 illustrates an occlusion-releasing device and frac plug being introduced into a wellbore.
Figure 5:
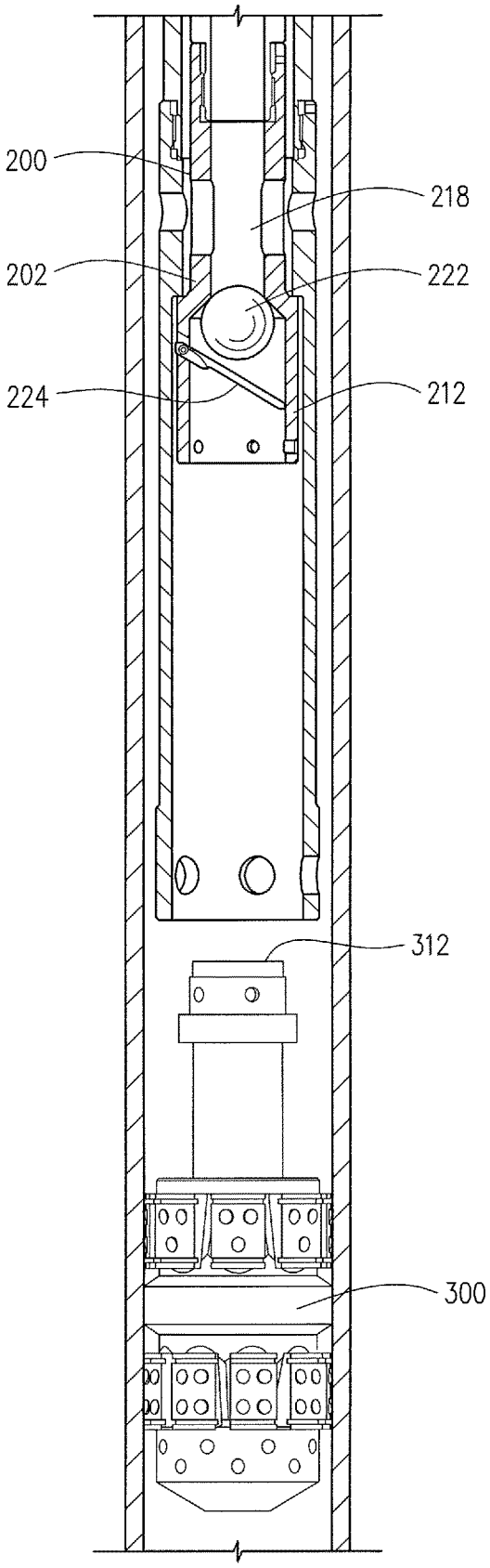
FIG. 5 illustrates the occlusion-releasing device and frac plug of FIG. 4 after the frac plug is set in the wellbore and released from the occlusion-releasing device.
Figure 6:
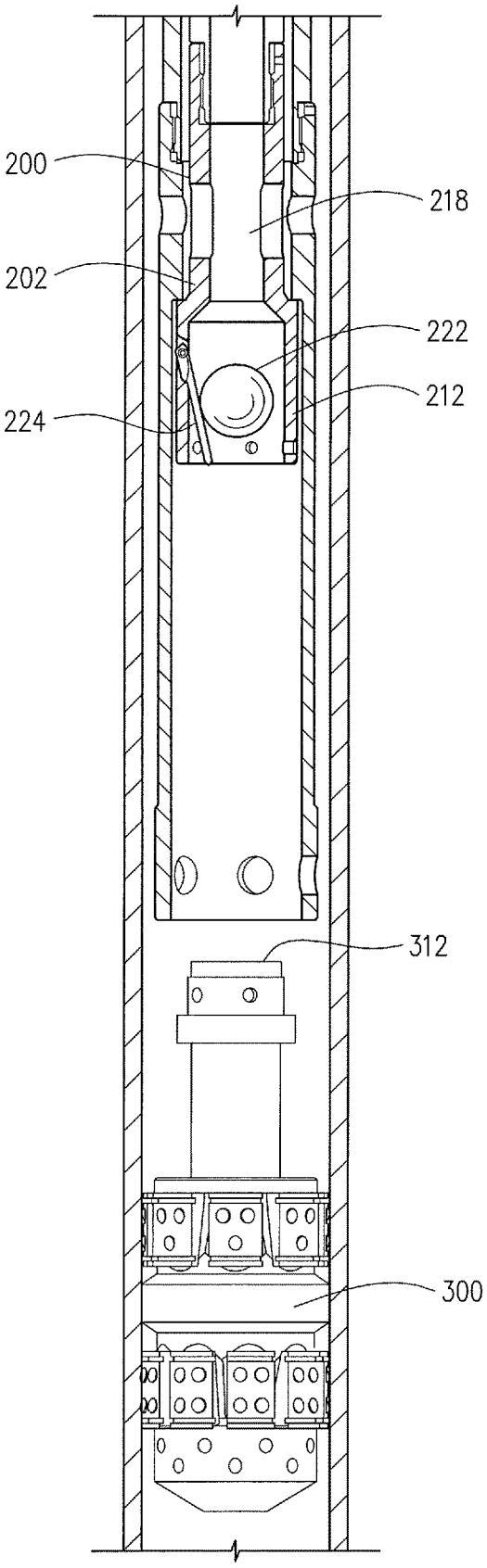
FIG. 6 illustrates the occlusion-releasing device and frac plug of FIG. 5 after the flapper has been moved to its open position.
Figure 7:
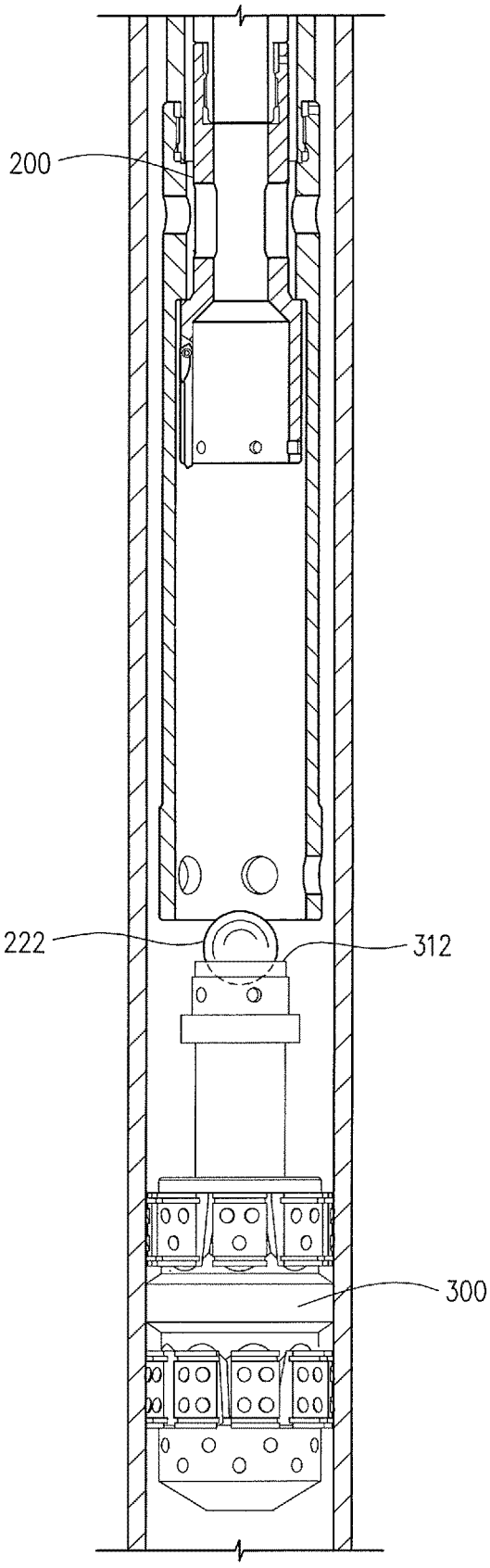
FIG. 7 illustrates the occlusion-releasing device and frac plug of FIG. 6 after the occlusion has moved into sealing engagement with the frac plug.
Figure 5:
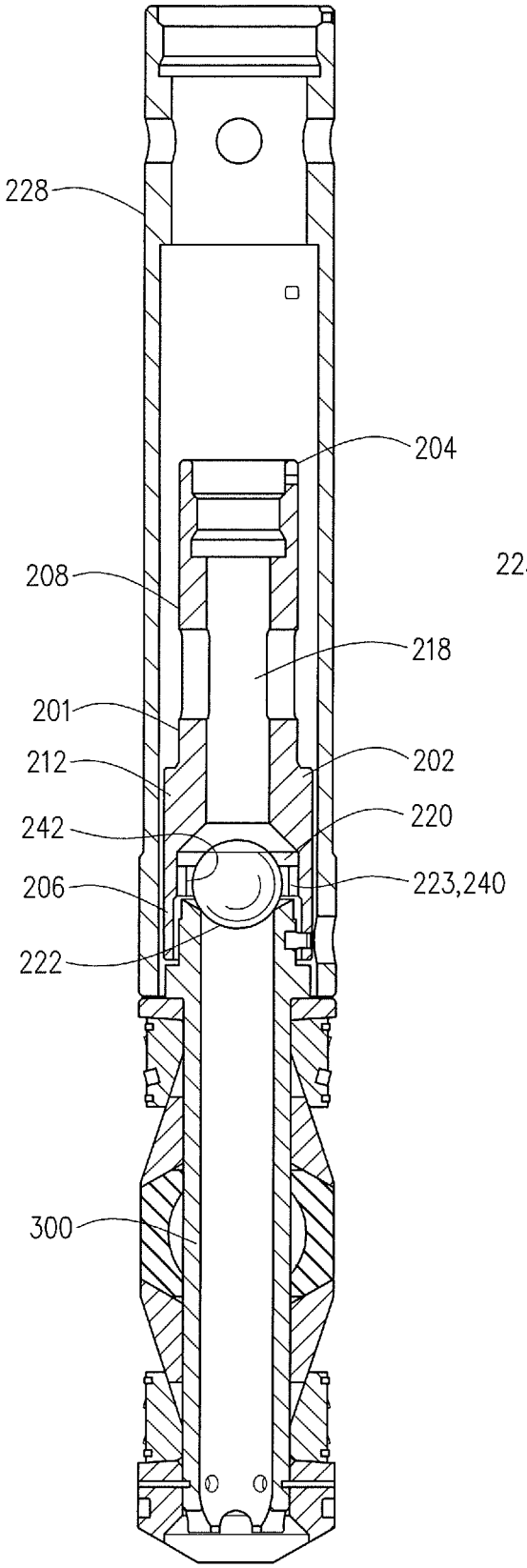
Figure 3:
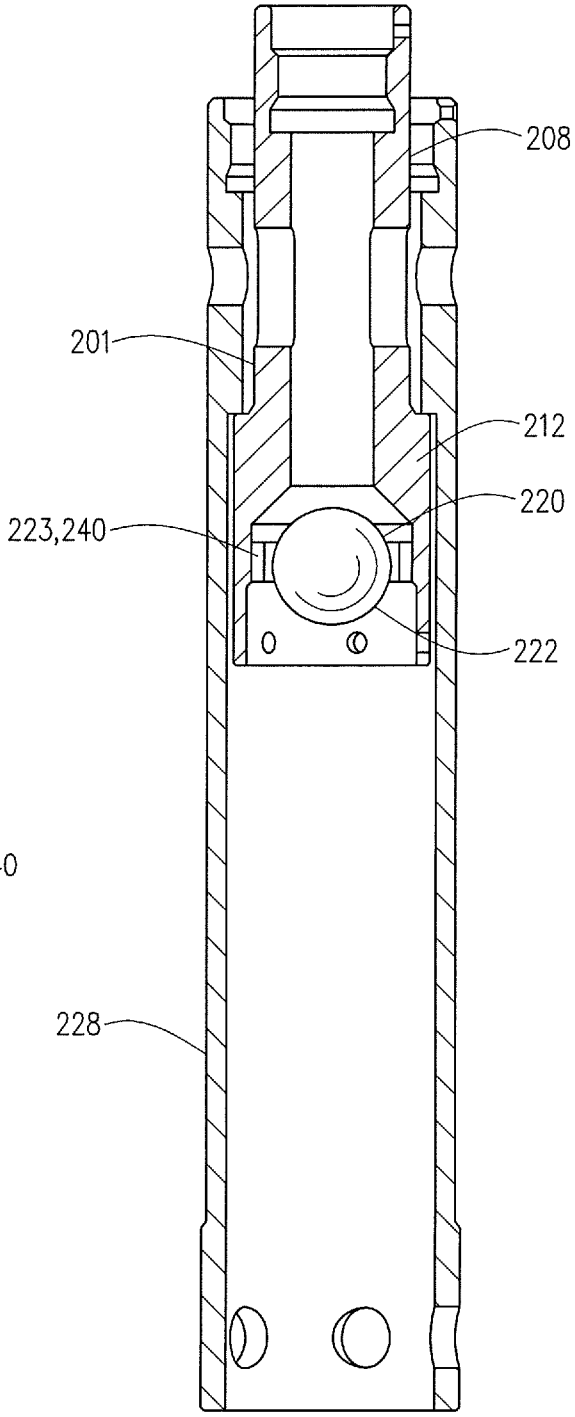

As can be seen from FIG. 4, flapper 224 is prevented from moving to its open position during introduction into the wellbore and before setting of frac plug 300 by contact with upper end 304 of frac plug 300. As can be seen from FIG. 5, after setting and release of frac plug 300, flapper 224 is no longer blocked from moving to its open position by frac plug 300; however, because it is resiliently biased to its closed position, it remains closed retaining occlusion 222 within body portion 212 of shaft 202. Once a predetermined fluid pressure is applied to occlusion 222 from uphole through flow passage 218, the bias of flapper 224 is overcome and flapper 224 is moved to its open position allowing occlusion 222 to move downward, as shown in FIG. 6. The fluid flow and fluid pressure then move occlusion 222 downward until it comes into sealing engagement with seat 312 of frac plug 300, as shown in FIG. 7. Once occlusion 222 is in sealing engagement with seat 312 fluid flow through flow passage 310 of frac plug 300 is prevented.

Those skilled in the art will appreciate that wellbores do not always extend downward but can extend horizontal or even angled upwards. Accordingly, gravity can be insufficient to move occlusion 222 from occlusion-releasing tool 200. Past attempts to release an occlusion remotely (not dropping the occlusion downhole when needed) have relied on integrated controllers and/or complicated electrical or mechanical release mechanisms to release an occlusion and provide it sufficient momentum to engage with a frac plug. The embodiments described herein all rely on a forced preferential flow of fluid in the downhole direction to free the occlusion from retainment and engage it with the frac plug; thus avoiding integrated controllers and complicated release mechanisms. Further, as indicated above, the embodiments are described by the terms "upper," "upward," "uphole," "lower," "below," "downhole" and these terms, as used herein, mean in relation to the bottom or furthest extent of the surrounding wellbore even though the wellbore or portions of it may be deviated or horizontal. For example, "downhole" means towards the bottom or furthest extent of the wellbore from the surface, and "uphole" means away from the bottom or further extent of the wellbore from the surface or towards the surface.

Turning now to FIGS. 8 and 9, an alternative embodiment is illustrated. As for FIGS. 2 and 3, there is illustrated in FIGS. 8 and 9 an occlusion-releasing tool 201 connected to frac plug 300. Frac plug 300 is as described above for FIGS. 2 and 3 and will not be further described here.

Similar to the embodiment disclosed for FIGS. 2 and 3, occlusion-releasing tool 201 comprises a shaft 202 with a first or upper end 204 and a second or lower end 206. Shaft 202 has neck portion 208, and a body portion 212. At upper end 204, neck portion 208 is configured to attach to tubing or another tool, such as tubing 116 or perforation gun 120. At lower end 206, body portion 212 is configured to attach to frac plug 300.

Shaft 202 defines a flow passage 218 therethrough extending from the upper end 204 to the lower end 206 thereof. A seat 220 is defined within body portion 212. Seat 220 is configured to receive an occlusion 222, such that upward fluid flow pushes occlusion 222 into engagement with seat 220 and downward flow pushes occlusion out of engagement with seat 220. Seat 220 and occlusion 222 can but do not need to have a sealing engagement. That is, in many embodiments, when there is upward fluid flow or upward fluid pressure on occlusion 222, occlusion 222 will engage seat 220 but still allow fluid to flow past the engagement of occlusion 222 with seat 220.

Shaft 202 further comprises a mechanical retainer 223 (in this embodiment, resilient or elastic ring 240) within body portion 212. Resilient ring 240 defines an aperture 242 in which occlusion 222 is held until a predetermined fluid pressure uphole from occlusion 222 is exceeded. Resilient ring 240 grippingly engages occlusion 222 so as to hold occlusion 222 within body portion 212 and can hold occlusion 222 in engagement with seat 220. Resilient ring 240 holds occlusion 222 within body portion 212 until a predetermined fluid pressure is asserted on occlusion 222 from uphole within flow passage 218. Typically, a downward flowing fluid within flow passage 218 will assert the predetermined fluid pressure. For example, the predetermined fluid pressure can be achieved by the firing of perforating gun 120; thus, causing sufficient downward fluid flow and fluid pressure on occlusion 222 to overcome the hold of resilient ring 240. As illustrated in FIG. 8, while frac plug 300 is connected to lower end 206 of shaft 202 (prior to setting of frac plug 300 in the wellbore), the upper end 304 of frac plug 300 is positioned so as to prevent the release of occlusion 222 from resilient ring 230; thus, preventing occlusion 222 from being released from body portion 212 prior to setting of the frac plug. After frac plug 300 has been set and released from shaft 202, occlusion-releasing tool 201 is moved uphole so that upper end 304 no longer prevents resilient ring 240 from releasing occlusion 222, as shown in FIG. 9. Resilient ring 240 can be rubber, neoprene, or similar material.

Occlusion-releasing tool 201 further comprises a setting sleeve 228, which circumferentially surrounds and slidingly engages shaft 202. As shown, setting sleeve 228 is substantially the same as described for the embodiment of FIGS. 2 and 3.

In another embodiment (not shown), the mechanical retainer can be a collet internal to or contained in the flow passage of the occlusion-releasing tool, such as by the collet being connected to or forming part of the shoulder between the neck portion and body portion. Generally, the collet will be a segmented band or sleeve positioned in the flow passage to grippingly engage the occlusion. Accordingly, the collet forms a collar around the occlusion and exerts a strong clamping force on the occlusion to hold the occlusion in place until a predetermined fluid pressure uphole from occlusion is exceeded. For example, the collet may comprise a set of collet fingers extending longitudinally along the flow path. The collet fingers can be resiliently biased towards a relaxed position, which will not hold the occlusion. The collet fingers also have a tense position radially inward from the relaxed position which holds the occlusion by the strong clamping force. As the occlusion-releasing tool is lowered into the wellbore, the collet is in a longitudinally upward position in the flow path such that a slanted shoulder in the shaft forces the collet fingers radially inward to the tensed position, thus the occlusion is clamped firmly in place. Later when the fluid flow from uphole achieves a predetermined pressure on the occlusion and collet, the collet moves longitudinally downward further into the body portion of the shaft, thus the collet is no longer retained in the tense position by the shoulder. When this happens, the collet fingers resiliently move towards the relaxed position and release the occlusion to move downward in the flow passage towards the frac plug.

In accordance with the above description, various embodiments will now be described. In a first embodiment there is provided a downhole tool for use in a wellbore defined by a wellbore wall extending through a subterranean formation. The downhole tool comprises a shaft, an occlusion and a mechanical retainer. The shaft has a first end, a second end and a flow passage. The flow passage extends longitudinally along a central axis of the shaft and extends from said first end to said second end. The occlusion is contained within a portion of the flow passage. The mechanical retainer is configured to hold the occlusion within the flow passage until fluid pressure, applied to the occlusion by fluid within the flow passage, exceeds a predetermined fluid pressure and, when the predetermined fluid pressure is exceeded, the mechanical retainer releases the occlusion. In many embodiments, the flow passage, occlusion and mechanical retainer are configured such that fluid flow through the flow passage acts directly on the occlusion to release it from the mechanical retainer. In other words, there is no plunger or similar mechanical means by which the fluid flow acts on such mechanical means which in turn acts on the occlusion to release the occlusion from the mechanical retainer. Generally, the fluid within the flow passage can flow against and around the occlusion when the occlusion is contained within the portion of the flow passage.

In some embodiments, the mechanical retainer is an elastic ring defining an aperture. The elastic ring is positioned in the flow passage, and the occlusion is held in the aperture of the elastic ring until the predetermined fluid pressure is exceeded.

In other embodiments, the mechanical retainer is a spring-loaded flapper located within the flow passage. The flapper holds the occlusion in the flow passage until the predetermined fluid pressure is exceeded.

The second end of the shaft can be configured to connect to a frac plug. When the frac plug is connected to the second end, the frac plug prevents the mechanical retainer from releasing the occlusion.

In some embodiments, the downhole tool further comprises a setting sleeve around the shaft. The movement of the setting sleeve relative to the shaft and frac plug sets the frac plug in the wellbore and releases the shaft from the frac plug such that the mechanical retainer can release the occlusion when the predetermined pressure is exceeded.

In other embodiments, there is provided a system for use in a wellbore defined by a wellbore wall extending through a subterranean formation, the system comprises a frac plug and an occlusion-releasing tool. The frac plug is configured to receive an occlusion. The occlusion-releasing tool comprises a shaft, an occlusion and a mechanical retainer in accordance with the above-described downhole tool embodiment.

In the system, the second end of the shaft is configured to connect to the frac plug so as to prevent the mechanical retainer from releasing the occlusion. After the frac plug is set or during setting of the frac plug in the wellbore, the shaft is released from the frac plug such that the frac plug no longer prevents the mechanical retainer from releasing the occlusion. Thereafter, when the predetermined fluid pressure is exceeded, the mechanical retainer releases the occlusion to engage the frac plug so as to prevent flow through the frac plug in one direction.

In many embodiments, the occlusion-releasing tool further comprises a setting sleeve around the shaft, wherein the movement of the setting sleeve relative to the shaft and frac plug sets the frac plug in the wellbore and releases the shaft from the frac plug such that the mechanical retainer can release the occlusion when the predetermined pressure is exceeded.

In yet other embodiments, there is provided a process for introducing a downhole tool into a wellbore defined by a wellbore wall. The process comprises the step of first introducing the downhole tool into the wellbore. The downhole tool has an occlusion-releasing tool and a frac plug, The occlusion-releasing tool is as described in the above embodiments with a second end, or downstream end, connected to the frac plug such that a mechanical retainer, which holds an occlusion within the occlusion-releasing tool, is prevent from releasing the occlusion by the connection of the downstream end to the frac plug.

Next, the frac plug is set in the wellbore such that the occlusion-releasing tool is disconnected from the frac plug such that the frac plug no longer prevents the release of the occlusion from the occlusion-releasing tool.

After the setting and disconnecting of the frac plug, the occlusion is released by applying a predetermined fluid pressure to the occlusion such that the mechanical retainer releases the occlusion so that the occlusion engages the frac plug to prevent flow through the frac plug in one direction.

In some of these embodiments, the occlusion-releasing tool comprises a shaft and a setting sleeve. In these embodiments, the process comprises containing the occlusion within a longitudinal flow path within the shaft until after the frac plug is set. The setting of the frac plug is by moving the setting sleeve relative to the shaft and the frac plug.

In some of the embodiments of the process, the mechanical retainer is an elastic ring defining an aperture. The elastic ring is positioned in the flow passage, and the occlusion is held in the aperture of the elastic ring until the predetermined fluid pressure is exceeded. In such embodiments, prior to setting the frac plug, the frac plug engages the occlusion such that the occlusion cannot move out of the elastic ring.

In other embodiments of the process, the mechanical retainer is a spring-loaded flapper located within the flow passage. The flapper holds the occlusion in the flow passage and, when the predetermined fluid pressure is exceeded, the flapper resiliently moves to allow the occlusion to move into the frac plug. In such embodiments, prior to setting the frac plug, the frac plug engages the flapper so as to prevent the flapper from resiliently moving sufficiently to allow the occlusion to be released, hence to move out of the occlusion-releasing tool and engage the frac plug.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

What is claimed is:

1. A downhole tool for use in a wellbore defined by a wellbore wall extending through a subterranean formation, the downhole tool comprising:

a shaft having a first end, a second end and a flow passage, wherein the flow passage extends longitudinally along a central axis of the shaft and extends from said first end to said second end, and wherein the second end of the shaft is configured to connect to a frac plug;

an occlusion contained within a portion of the flow passage; and a mechanical retainer configured to hold the occlusion within the flow passage until fluid pressure, applied to the occlusion by fluid within the flow passage, exceeds a predetermined fluid pressure and, when the predetermined fluid pressure is exceeded, the mechanical retainer releases the occlusion, and wherein, when the frac plug is connected to the second end of the shaft, the frac plug prevents the mechanical retainer from releasing the occlusion.

2. The downhole tool of claim 1, wherein the mechanical retainer is an elastic ring defining an aperture, wherein the elastic ring is positioned in the flow passage, and the occlusion is held in the aperture of the elastic ring until the predetermined fluid pressure is exceeded.

3. The downhole tool of claim 1, wherein the mechanical retainer is a spring-loaded flapper located within the flow passage, wherein the flapper holds the occlusion in the flow passage until the predetermined fluid pressure is exceeded.

4. The downhole tool of claim 1, wherein fluid within the flow passage can flow against and around the occlusion when the occlusion is contained within the portion of the flow passage.

5. The downhole tool of claim 1, further comprising a setting sleeve around the shaft, wherein the movement of the setting sleeve relative to the shaft and frac plug sets the frac plug in the wellbore and releases the shaft from the frac plug such that the mechanical retainer can release the occlusion when the predetermined pressure is exceeded.

6. The downhole tool of claim 5, wherein the mechanical retainer is an elastic ring defining an aperture, wherein the elastic ring is positioned in the flow passage, and the occlusion is held in the aperture of the elastic ring until the predetermined fluid pressure is exceeded.

7. The downhole tool of claim 5, wherein the mechanical retainer is a spring-loaded flapper located within the flow passage, wherein the flapper holds the occlusion in the flow passage until the predetermined fluid pressure is exceeded.

8. The downhole tool of claim 7, wherein fluid within the flow passage can flow against and around the occlusion when the occlusion is within the portion of the flow passage.

9. A system for use in a wellbore defined by a wellbore wall extending through a subterranean formation, the system comprising:

a frac plug configured to receive an occlusion; and an occlusion-releasing tool comprising:

a shaft having a first end, a second end and a flow passage, wherein said flow passage extends longitudinally along a central axis of the shaft and extends from said first end to said second end, and wherein the second end is configured to connect to the frac plug;

the occlusion, which is contained within a portion of the flow passage; and a mechanical retainer configured to hold the occlusion within the flow passage until fluid pressure applied to the occlusion by fluid within the flow passage exceeds a predetermined fluid pressure and, when the predetermined fluid pressure is exceeded, the mechanical retainer releases the occlusion to engage the frac plug so as to prevent flow through the frac plug in one direction, and wherein when the frac plug is connected to the second end, the frac plug prevents the mechanical retainer from releasing the occlusion.

10. The system of claim 9, wherein the occlusion-releasing tool further comprises a setting sleeve around the shaft, wherein the movement of the setting sleeve relative to the shaft and frac plug sets the frac plug in the wellbore and releases the shaft from the frac plug such that the mechanical retainer can release the occlusion when the predetermined pressure is exceeded.

11. The system of claim 10, wherein the mechanical retainer is an elastic ring defining an aperture, wherein the elastic ring is positioned in the flow passage and the occlusion is held in the aperture of the elastic ring until the predetermined fluid pressure is exceeded.

12. The system of claim 10, wherein the mechanical retainer is a spring-loaded flapper located within the flow passage, wherein the flapper holds the occlusion in the flow passage until the predetermined fluid pressure is exceeded.

13. The system of claim 10, wherein fluid within the flow passage can flow against and around the occlusion when the occlusion is within the portion of the flow passage.

14. A process for introducing a downhole tool into a wellbore defined by a wellbore wall, the process comprising:

introducing the downhole tool into the wellbore, the downhole tool having an occlusion-releasing tool and a frac plug, wherein the occlusion-releasing tool has an upstream end and a downstream end with the downstream end connected to the frac plug such that a mechanical retainer, which holds an occlusion within the occlusion-releasing tool, is prevented from releasing the occlusion by the connection of the downstream end to the frac plug;

setting the frac plug in the wellbore such that the occlusion-releasing tool is disconnected from the frac plug; and releasing the occlusion after the setting of the frac plug, wherein the releasing is by applying a predetermined fluid pressure to the occlusion such that the mechanical retainer releases the occlusion so that the occlusion engages the frac plug to prevent flow through the frac plug in one direction.

15. The process of claim 14, wherein the occlusion-releasing tool comprises a shaft and a setting sleeve, wherein the occlusion is contained within a longitudinal flow path within the shaft, and wherein the setting of the frac plug is by moving the setting sleeve relative to the shaft and the frac plug.

16. The process of claim 15, wherein the mechanical retainer is an elastic ring defining an aperture, wherein the elastic ring is positioned in the flow passage and the occlusion is held in the aperture of the elastic ring until the predetermined fluid pressure is exceeded.

17. The process of claim 16, wherein prior to setting the frac plug, the frac plug engages the occlusion such that the occlusion cannot move out of the elastic ring.

18. The downhole tool of claim 15, wherein the mechanical retainer is a spring-loaded flapper located within the flow passage, wherein the flapper holds the occlusion in the flow passage and, when the predetermined fluid pressure is exceeded, the flapper resiliently moves to allow the occlusion to move into the frac plug.

19. The process of claim 18, wherein prior to setting the frac plug, the frac plug engages the flapper so as to prevent the flapper from resiliently moving sufficiently to allow the occlusion to move into the frac plug.

* * * * *